United States Patent [19]

Derksen et al.

[11] Patent Number: 5,054,933

[45] Date of Patent: Oct. 8, 1991

[54] MIXING DEVICE WITH MEANS TO INTRODUCE AND EXTRACT GASEOUS MATERIAL

[75] Inventors: Michael Derksen, Lüdenscheid; Joachim Domke, Menden, both of Fed. Rep. of Germany

[73] Assignee: Dr. Herfeld GmbH & Co., KG, Fed. Rep. of Germany

[21] Appl. No.: 408,725

[22] Filed: Sep. 18, 1989

[30] Foreign Application Priority Data

Nov. 7, 1988 [DE] Fed. Rep. of Germany ..... 3837673

[51] Int. Cl.[5] ..... B01F 9/08; B01F 15/02

[52] U.S. Cl. ..... 366/138; 251/144; 366/182; 366/191; 366/192; 366/200; 366/213; 366/220

[58] Field of Search ..... 366/192–194, 366/244, 245, 247, 249, 251, 138, 139, 184, 150, 208, 209, 219, 220, 213, 214, 215, 218, 223, 197, 163, 242, 191, 182; 251/144; 137/212, 209, 583

[56] References Cited

U.S. PATENT DOCUMENTS

| | | | |
|---|---|---|---|
| 583,751 | 6/1897 | James | 366/192 |
| 862,714 | 8/1907 | Constantinov | 137/583 |
| 956,065 | 4/1910 | Fleming | 366/192 |
| 1,060,142 | 4/1913 | Stevens | 251/144 |
| 1,926,095 | 9/1933 | Graves | 251/144 |
| 2,628,080 | 2/1953 | Mack | 366/139 |
| 2,838,392 | 6/1958 | Bielawski | 366/139 X |
| 2,941,908 | 6/1960 | Logan | 366/139 X |
| 3,137,327 | 6/1964 | Muench | 366/197 X |
| 3,224,741 | 12/1965 | Muench, Sr. | 366/241 X |
| 3,227,425 | 1/1966 | Stanier | 366/192 |
| 3,992,148 | 11/1976 | Shore et al. | 366/147 X |
| 4,037,753 | 7/1977 | Brandau | 251/144 |
| 4,199,153 | 4/1980 | Martin | 366/139 X |
| 4,671,666 | 6/1987 | Herfield | 366/222 |
| 4,676,658 | 6/1987 | Herfield | 366/222 |
| 4,781,468 | 11/1988 | Herfield | 366/249 |

FOREIGN PATENT DOCUMENTS

| | | | |
|---|---|---|---|
| 2256361 | 7/1975 | France | 251/144 |

*Primary Examiner*—Philip R. Coe
*Assistant Examiner*—C. Cooley
*Attorney, Agent, or Firm*—Learman & McCulloch

[57] ABSTRACT

The invention relates to a mixing device with a mixing vessel which can be pivoted by 180° between a starting position and a mixing position. The vessel part which is permanently connected to the pivot shaft includes an extraction mechanism by means of which any dust-laden gases present in the vessel can be extracted before the vessel is opened. A preferred further embodiment of the invention facilitates the delivery of protective gas to the mixing vessel.

7 Claims, 3 Drawing Sheets

MIXING DEVICE WITH MEANS TO INTRODUCE AND EXTRACT GASEOUS MATERIAL

The invention relates to a mixing device of the type for mixing bulk materials in powdered or granular form.

BACKGROUND OF THE INVENTION

Mixing devices of the type for mixing bulk materials are disclosed for example in DE-C2 110 047 and EP-A-168 564.

During operation of such mixing devices an over-pressure often occurs in the interior of the mixing vessel, and, depending upon the type of material to be mixed—this often leads to a considerable development of dust when the mixing vessel is opened.

The object of the invention, therefore, is to construct a mixing device in such a way that a disruptive development of dust upon opening the mixing vessel is avoided.

SUMMARY OF THE INVENTION

The invention relates to a mixing device for bulk materials including a mixing vessel having an extractor opening therein and an extraction means operatively mounted on the vessel at the extraction opening for opening and closing the latter at predetermined times to extract residual materials, such as gas and fine particles, from the vessel. Accordingly, before opening the mixing vessel after carrying out a mixing operation it is possible by means of such an extraction arrangement to reduce the over-pressure prevailing in the mixing vessel and extract the dust which has formed, so that when the mixing vessel is then opened there is no further dust pollution for the environment.

The invention also relates to a mixing device assembly as set forth above but also including a means for introducing a protective gas into the mixing vessel in order to be able to carry out the mixing process under conditions of protection against explosion. During filling of the mixing vessel with the protective gas the extraction arrangement permits the extraction of the oxygen atmosphere and after the end of the mixing operation permits the extraction of the protective gas.

THE DRAWINGS

Two embodiments of the invention will be explained in greater detail below with the aid of the accompanying drawings wherein:

FIG. 1 is a perspective side view of a mixing device according to the invention in the starting position, FIG. 2 is a partial cross-section through the vessel showing the extraction arrangement, FIG. 3 is a partial cross-section through a second embodiment in which protective gas can be introduced into the mixing vessel.

DETAILED DESCRIPTION

Figure 1:
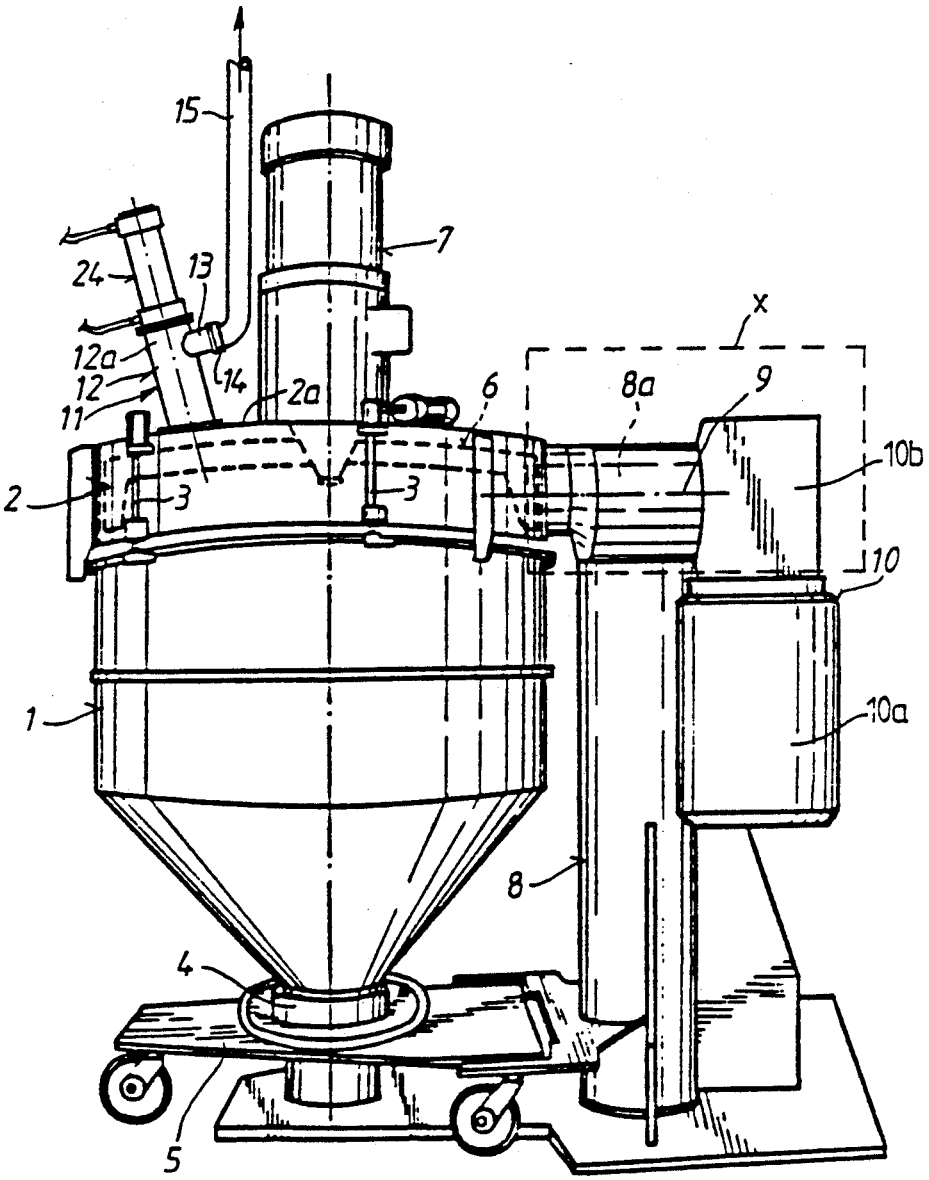
Figure 2:
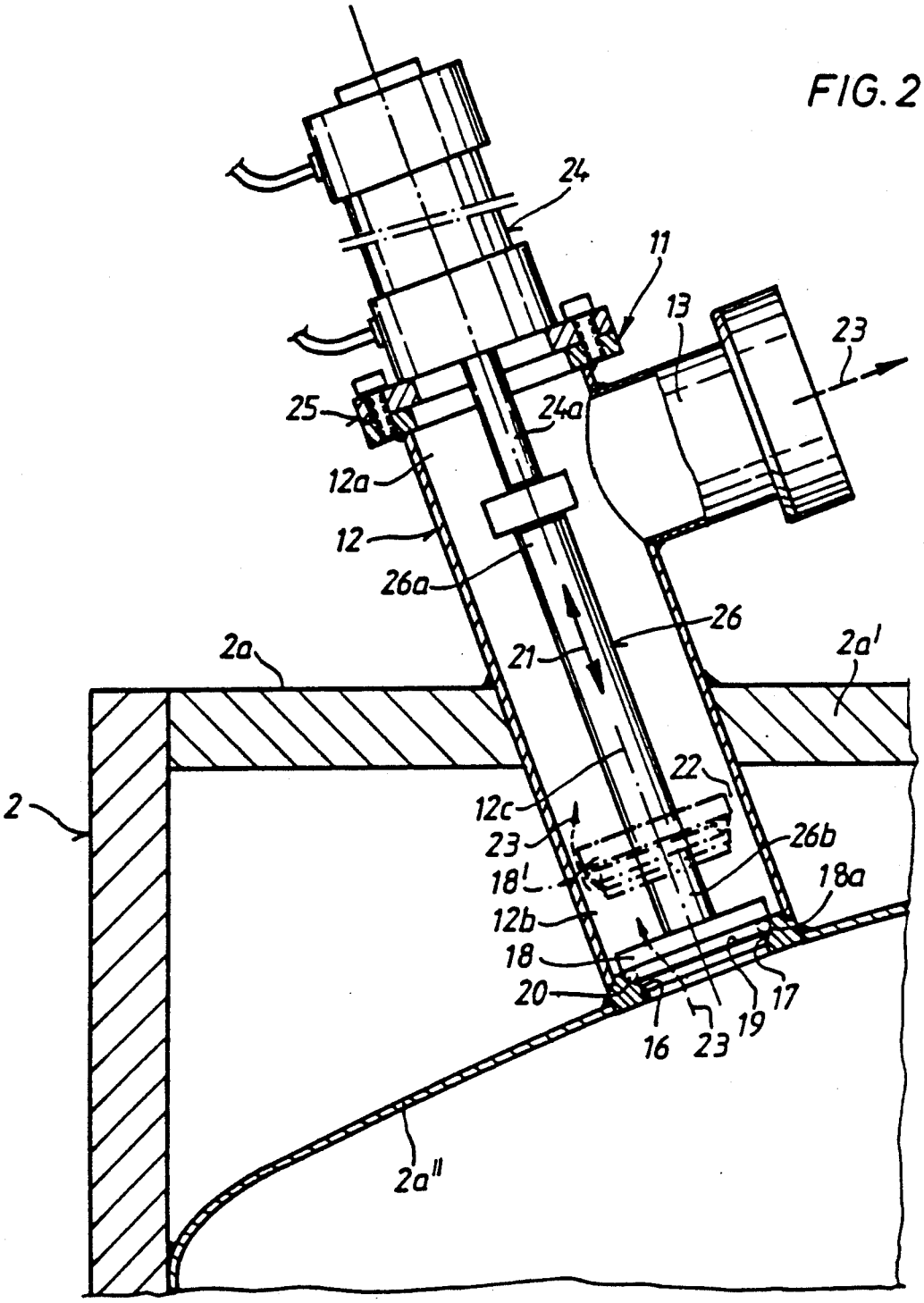

The mixing device for mixing bulk material is illustrated in FIGS. 1 and 2. The mixing device of the invention contains a mixing vessel which consists of two bowl-shaped vessel parts 1 and 2 which can be fixed to one another at their open ends facing one another with the aid of clamping devices 3 to form a mixing chamber. The first vessel part 1 which is provided with a base outlet 4 can be moved with the aid of a travelling pallet 5.

The second vessel part 2 contains mixing tools 6 disposed in its interior and which are driven by a drive motor 7. The second vessel part 2 is fixed on a columnlike stationary mounting 8 by means of a pivot shaft 8*a* having a horizontal pivot axis 9. The pivot shaft 8*a* is driven by a pivot drive 10 consisting of a drive motor 10*a* and a slip-on gear 10*b*.

The second vessel part 2 can be pivoted by the pivot drive 10 by approximately 180° about the horizontal pivot axis 9 between a starting position (FIG. 1), in which the second vessel part 2 forms the cover of the mixing vessel chamber, and a mixing position, in which the second vessel part 2 forms the base of the mixing vessel chamber.

An extraction means 11 is mounted on the second vessel part 2, on the base wall 2*a* thereof which is located at the top in the starting position. The extraction means includes an extraction mechanism having a tubular, preferably cylindrical extraction housing 12. The extraction housing 12 has a connection 13 near its upper end 12*a* which can be connected to an extraction pipe 15 by means of a pipe coupling 14. The pipe coupling 14 may be of the fast coupling type. This extraction pipe 15 is part of the extraction mechanism which also includes a filter (not shown; and extractor fan. Optionally, the end of the extraction pipe 15 which can be connected to the connection 13 can also be of flexible construction in order to facilitate a rapid coupling to the connection 13.

The extraction housing 12 is fixed for example welded onto the base wall 2*a*. It projects with its lower end through an outer part of the base wall 2*a*′ and is connected to an inner base wall part 2*a*″ at a point at which a circular extraction opening 16 is provided in the inner base well part 2*a*′ of the second vessel part 2. The extraction opening 16 is surrounded by a conically diverging circular seal seat 17 which widens in the direction of the extraction arrangement 11.

The extraction mechanism 11 contains a valve body 18, which is constructed substantially in the form of a circular disc. This valve body 18 fits accurately into the seal seat 17 of the extraction opening 16. For this purpose the valve body 18 has a sealing section 18*a* which tapers towards the seal seat 17. A groove 1*g* into which a sealing ring 20 is placed is provided on the periphery of this sealing section 18*a*.

The valve body 18 is moveable axially within the extraction housing 12 as indicated by the double arrow 21 between the closed position shown in solid lines in FIG. 2 and the open position 18′ illustrated by dash-dot lines. In the closed position which the valve body 18 takes up in the mixing position of the mixing vessel the valve body 18 closes the extraction opening 16 flush with the inner wall of the inner base wall pert 2*a*″. In the starting position of the mixing vessel, on the other hand, the valve body 18 can be brought into its open position 18′, thereby opening the extraction opening 16.

As can be seen in FIG. 2, the tubular extraction housing 12 has an internal cross-section which is greater than the cross-section of the extraction opening 16 and the diameter of the valve body 18. In this way, in the open position 18′ of the valve body 18 an annular extraction gap 22 is produced between the periphery of the valve body 18 and the inner wall of the extraction housing 12. Dust-laden gases can past through this annular extraction gap 22 corresponding to the arrows 23 from the extraction opening 16 to the connection 13.

The assembly further includes a retractor means operatively connected to the valve body 18 for moving the valve body 18 between the open and closed positions.

In the preferred embodiment the retractor means includes a cylinder-piston unit operated by a pressure medium and taking the form of a compressed air cylinder 24 is provided for actuation of the valve body 18 and is axially flanged (flange connection 25) onto the upper end 12*a* of the extraction housing 12 facing away from the extraction opening 16. The piston rod 24*a* of the compressed air cylinder 24 is fixed to the end 28*a* of an actuating rod 26, the other end 26*b* of which bears the valve body 18. Thus by actuation of the compressed air cylinder 24 the valve body 18 can be moved between the open and closed positions relative to the extractor opening and in the direction of the longitudinal axis 12*c* of the housing.

The making and release of the coupling between the extraction pipe 15 and the connection 13 can be notified by end switches to a control arrangement belonging to the mixing device, so that the actuation of the valve body 18 by the compressed air cylinder 24 is controlled as a function of the actuation of these end switches.

The operation of the mixing device described above can be carried out as follows:

In the mixing position of the mixing vessel the extraction opening 18 in the second vessel part 2 is kept completely closed by means of the valve body 18. For this purpose the extraction opening 18 is closed before the mixing vessel is pivoted out of the starting position into the mixing position.

If after the mixing operation the mixing vessel is pivoted back into the starting position, then the extraction arrangement 11 is coupled to the extraction pipe 15 (via the connection 13 and the pipe coupling 14). Thereupon the extraction opening 16 is opened by the valve body 18.

In this way the chamber of the mixing vessel, which is still closed, is connected by the extraction mechanism 11 and the unwanted gases and particles are sucked out of the vessel through the housing 11 and into the extraction pipe 15. The duration of the extraction operation can be for example 10 s in practice. In this way the overpressure in the mixing vessel is reduced and the dust is removed.

Then the two vessel parts 1 and 2 ere released from one another, and no dust pollution enters the environment. The extraction opening 16 is then closed again by the valve body 18.

Figure 3:
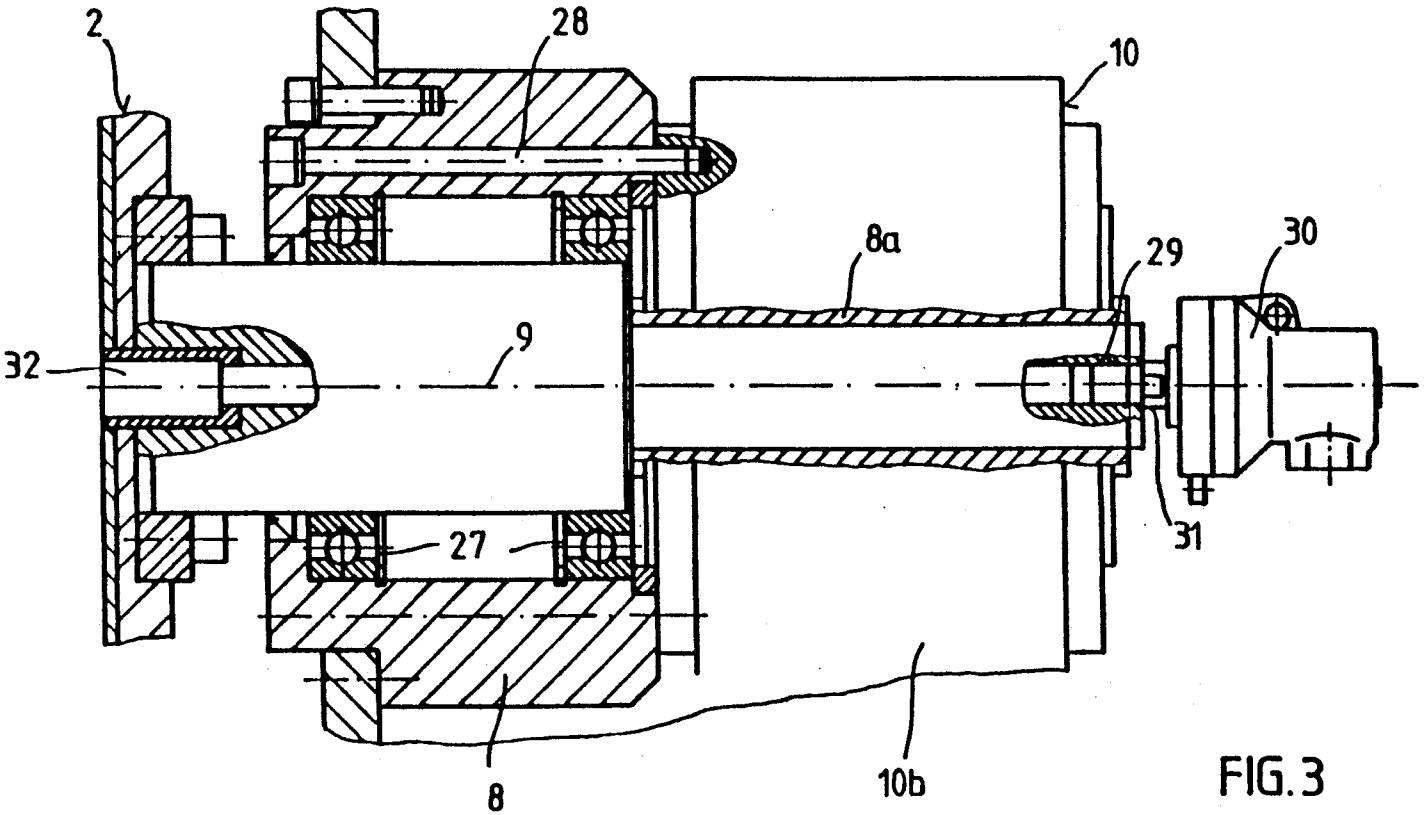

FIG. 3 shows a further embodiment of the mixing device according to the invention which makes it possible to carry out the mixing operation in a protective gas atmosphere (for example in a nitrogen atmosphere) in order to protect against explosion.

FIG. 3 merely illustrates the region which is bounded by broken lines in FIG. 1 and characterised by the reference x.

In FIG. 3 the pivot shaft 8*a* can be seen by means of which the slip-on gear 10*b* of the pivot drive 10 is connected to the second vessel part 2 so as to be fixed against rotation. This pivot shaft 8*a* is rotatably mounted by means of bearings 27 in the stationary mounting 8. The slip-on gear 10*b* is fixed on the mounting 8 by means of screws 28.

The pivot shaft 8*a* is constructed as a hollow shaft in the embodiment according to FIG. 3. A pipe 29 which serves to deliver protective gas into the vessel which is rotatably supported by the pivot shaft 8*a*.

The other end of the pipe 29 is connected by a sealing head 30 to a stationary protective gas delivery pipe (not shown) which is laid so as to be fixed against rotation. Further, there is e sealed rotary connection 31 between the sealing head 30 and the pipe 29.

A valve 32, the details of which are not shown in FIG. 3, is arranged at the point where the pipe 29 opens into the interior of the second vessel part 2. This valve 32 opens under pressure i.e. when protective gas is delivered under pressure via the pipe 29. In the pressureless state the valve closes and is preferably flush with the inner wall of the second vessel part 2.

A measuring point to which a measuring system for the residual oxygen can be connected can be provided in the extraction system which is described with the aid of FIGS. 1 and 2.

The way in which the process proceeds in the embodiment according to FIG. 3 is set forth in further detail below:

The first vessel part 1, which is filled with the product, is moved under the second vessel part 2 and coupled thereto by means of the pneumatic clamping device 3. If the coupling is produced (which is notified by end switches) and if the lifting cylinders (which have raised the first vessel part 1 to produce the coupling) are again in their lower position, then protective gas (for example nitrogen) is delivered via a valve (not shown in the drawing) to the pipe 29 and introduced via the valve 32 into the mixing vessel chamber. The delivery pressure can for example be 1 to 2 bars. At the same time the valve body 18 of the extraction arrangement 11 opens, so that the mixed atmosphere (oxygen/protective gas) forming in the mixing vessel is drawn off via the extraction pipe 15.

If after a certain time there is a pure protective gas atmosphere in the mixing vessel chamber (which can be determined by the residual oxygen measuring system mentioned above). then the valves on the delivery side and the extraction side are closed. The mixing operation can now proceed under protective gas. Since the mixing vessel chamber is hermetically sealed against the exterior, there is no need for further protective gas to be delivered in order to maintain the conditions of protection against explosion.

After the end of the mixing operation extraction of the gas particles from the mixing vessel chamber is carried out in the manner already described by means of the extraction mechanism 11, then the mixing vessel can be opened.

What is claimed is:

1. A mixing device for mixing dust-producing bulk material in powdered and granular form, said device comprising stationary mounting means having a pivot shaft; a mixing vessel having first and second bowl-shaped vessel parts removably coupled together to form a mixing chamber, said first vessel part having mixed material outlet means, said second vessel part having rotatable mixing tools therein, said second vessel part having an extraction opening therein through which dust-laden gas may be extracted from said chamber, said second vessel part being mounted on said stationary mounting means via said pivot shaft for pivoting of said mixing vessel between a first position in which said second vessel part defines a top cover for said chamber and an inverted mixing position in which said second vessel part defines a base for said chamber; extraction valve means movable between first and second positions in which said valve means respectively closes and opens said extraction opening; means for moving said valve means between said positions; extracting means operable when said valve means is in its second position and said mixing vessel is in said first position to extract dust-laden gas from said chamber via said extraction opening; and means separate from said extraction means for introducing a protective, anti-explosion gas into said chamber via said second vessel part while said extraction opening is opened and said gas-laden dust is extracted from said chamber.

2. A mixing vessel set forth in claim 1 wherein said extraction means includes an extraction mechanism having a housing and a valve body movable within said housing between said open position displaced from said extraction opening and said closed position in sealing engagement with said extraction opening.

3. A mixing vessel as set forth in claim 2 wherein said mechanism includes an extraction pipe operatively and removably coupled to said housing for providing a path through which said dust-laden gas can exit said chamber.

4. A mixing vessel as set forth in claim 3 including retractor means operatively connected to said valve body for moving said valve body between said open and closed positions.

5. A mixing vessel as set forth in claim 4 wherein said retractor means includes a cylinder and a piston within said cylinder and movable between first and second positions, and an activating rod operatively connected at one end to said piston and extending out of said cylinder and operatively connected at its other end to said valve body to move said valve body between said open and closed positions.

6. A mixing vessel as set forth in claim 5 wherein said housing is tubular in shape and defines an internal cross-sectional area which is greater than the cross-sectional area of said extraction opening and said valve body so as to define an annular extraction gap between said valve body and said housing when said valve body is in said open position.

7. A mixing vessel as set forth in claim 6 wherein said extraction opening includes a conically diverging circular seal seat, said valve body including a sealing portion of complementary shape relative to said conically diverging circular seal seat of said extraction opening and a sealing ring operatively mounted on said sealing portion of said valve body to seal said extraction opening when said valve body is in said closed position.

* * * * *

UNITED STATES PATENT AND TRADEMARK OFFICE

CERTIFICATE OF CORRECTION

PATENT NO. : 5,054,933

DATED : October 8, 1991

INVENTOR(S) : Michael Derksen and Joachim Domke

It is certified that error appears in the above-identified patent and that said Letters Patent is hereby corrected as shown below:

Column 2, line 22, after "shown" change the semicolon to a closed parenthesis; line 31, change "well" to -- wall --; line 40, change "lg" to -- 19 --; line 50, change "pert" to -- part --.

Column 3, line 6, change "28a" to -- 26a; line 22, change "18" to -- 16 --; line 24, change "18" to -- 16 --; line 41, change "ere" to -- are --; line 67, change "e" to -- a --.

Column 4, line 33, after the closed parenthesis, change the period to a comma; line 41, after "gas" insert -- and --.

Signed and Sealed this

Sixteenth Day of February, 1993

*Attest:*

STEPHEN G. KUNIN

*Attesting Officer*

*Acting Commissioner of Patents and Trademarks*